US008137209B2

(12) United States Patent
Morelli

(10) Patent No.: US 8,137,209 B2
(45) Date of Patent: Mar. 20, 2012

(54) INDOOR AND OUTDOOR GOLF SWING TRAINING APPARATUS

(75) Inventor: Mike Morelli, Dayton, NV (US)

(73) Assignee: Michael Morelli, Dayton, NV (US)

( * ) Notice: Subject to any disclaimer, the term of this patent is extended or adjusted under 35 U.S.C. 154(b) by 12 days.

(21) Appl. No.: 12/688,743

(22) Filed: Jan. 15, 2010

(65) Prior Publication Data

US 2011/0177875 A1 Jul. 21, 2011

(51) Int. Cl.
*A63B 69/36* (2006.01)

(52) U.S. Cl. ..... 473/229; 473/258; 473/267

(58) Field of Classification Search ..... 473/219, 473/223, 226, 229, 230, 231, 257, 422, 258, 473/267

See application file for complete search history.

(56) References Cited

U.S. PATENT DOCUMENTS

| | | | | |
|---|---|---|---|---|
| 1,137,349 | A * | 4/1915 | Patterson | 482/127 |
| 5,716,286 | A * | 2/1998 | Swan | 473/175 |
| 5,816,928 | A * | 10/1998 | Colonna | 473/229 |
| 6,413,196 | B1 * | 7/2002 | Crowson | 482/118 |
| 2004/0224784 | A1 * | 11/2004 | Morelli | 473/229 |

* cited by examiner

*Primary Examiner* — Nini Legesse

(74) *Attorney, Agent, or Firm* — Kerr IP Group, LLC; Michael A. Kerr

(57) ABSTRACT

A golf training apparatus that is capable of operation both indoors and outdoors is described. The apparatus includes a plurality of anchor points, through which there are placed a plurality of anchors, typically comprising golf tees, for anchoring the apparatus outdoors. The apparatus further includes a cleated surface configured to adhere to a carpeted surface for anchoring the apparatus indoors. The apparatus further comprises a guide line retractably coupled to a tensile mechanism, whereby a golf player may, after coupling a golf club or putter to the guide line of the apparatus, determine based upon the motion of the guide line, whether the player's stroke is accurate or requires correction.

11 Claims, 10 Drawing Sheets

102
110
104b
103
104a 113b
112b
110
104b
113d
112d
113a
112a
160
104a
113c
112c 100
600
150
140
130
124
111
122
110
160

161
160
162

INDOOR AND OUTDOOR GOLF SWING TRAINING APPARATUS

FIELD

The present invention relates to a golf training device. More particularly, the present invention relates to an apparatus for training a person to swing efficiently a golf putter.

BACKGROUND

In the game of golf, it is important that players strike the ball with good technique. A good "stroke" (or swing), particularly a good putting stroke, typically travels through an arc in a single plane. In other words, for a good stroke, the club or putter does not wobble as it travels. Moreover, the arc along which the putter travels is aligned with the target (i.e., the golf ball) such that the face of the putter strikes the ball at a ninety degree angle (i.e., "squarely").

Frequently, however, players experience difficulty in achieving aligned strokes. Colloquially, players may say that they are "pushing" or "pulling" their strokes. For a right handed player, "pushing" means that the golf club (or putter) strikes the ball at an oblique angle, such that the ball is imparted with a trajectory that takes it to the right of the intended target. Similarly, a right handed player "pulls" a stroke when the player strikes the ball at an acute angle, such that the ball is imparted with a trajectory that takes it to the left of the intended target.

Accordingly, there is a need, and corresponding demand, in the golf world for swing analysis and correction. In this regard, players have two options. First, a player may hire a golf coach to improve her swing. Personal lessons, however, are expensive, and many amateur players cannot afford this option or would prefer, at least, a less expensive training option. To satisfy these players, a variety of mechanical training devices are available.

However, most mechanical trainers are designed for outdoor use, and as many golfers are unable to travel to a convenient location (e.g., a golf course) as regularly as they might like, many would prefer an indoor/at home mechanical training device.

Hence, there is a need for an inexpensive mechanical training device which is capable of indoor use. The present invention is directed to such a device and satisfies the presently felt need in the golf market for affordable and versatile swing correction and analysis.

SUMMARY

A golf training apparatus that is capable of both indoor and outdoor use is described. The apparatus includes a base, which includes several anchor points, as well as a cleated undersurface. During an outdoor mode of operation, golf tees are driven through the anchor points into a putting green to secure the apparatus. During an indoor mode of operation, the apparatus is secured by way of the cleated undersurface, which adheres to carpeting.

The apparatus further includes an annular housing, wherein there is disposed a tensile mechanism for dispensing and retracting a guide line. The guide line is attached, during operation, to the shaft of a golf club or golf putter. As the putter is swung by a player, the guide line dispenses and retracts in a fashion that permits the trainee to observe the line along which the swing is placed, as well as to detect any wobble in the swing.

The golf training apparatus may be packaged in a kit. The kit includes the components of the apparatus, disassembled, as well as several golf tees. A purchaser of the kit may easily assemble the components of the apparatus in several minutes (or less), such that the apparatus is functional and ready for use.

DRAWINGS

The illustrative embodiment will be more fully understood by reference to the following drawings which are for illustrative, not limiting, purposes.

DETAILED DESCRIPTION

Persons of ordinary skill in the art will realize that the following description is illustrative and not in any way limiting. Other embodiments of the claimed subject matter will readily suggest themselves to skilled persons having the benefit of this disclosure. It shall be appreciated by those of ordinary skill in the art that the golf training apparatuses, systems, and methods described hereinafter may vary as to configuration and as to details.

Further, as used in this application and the claims, the term "coupled" admits intermediate elements (i.e., coupled elements are not necessarily in direct physical contact) and includes various coupling techniques, such as mechanical coupling, slidable coupling, retractable coupling, pressure-fitted coupling, and the like. Further still, as used herein, the term "includes" means "comprises."

Broadly, a golf training device and a method for using the same are described herein. The apparatus may be used indoors and outdoors, and to that end, is capable of two configurations—i.e., a first configuration for operation of the apparatus indoors and a second configuration for operation of the apparatus outdoors.

With respect to FIG. 1A, a golf training apparatus 100 (hereinafter, also referred to simply as the "apparatus") configured for indoor use is pictured. The apparatus includes a base 110, an elongated support member 122, and an annular housing 124.

In a preferred embodiment, the base 110 comprises a rigid plastic, and may be injection molded or machined from a larger block of plastic. Alternately, the base may be assembled from a variety of prefabricated base elements. Further, in other embodiments, the base may comprise a metal or metal alloy, wood or a wood composite, any combination of the foregoing materials, and any of the other variety of materials which are available for use in the manufacture of objects and articles.

The elongated support member 122 and the annular housing 124 may comprise a material similar to that used in the construction or manufacture of the base 110 (see above), such as, for example, a hard plastic. Further, the elongated support member 122 and the annular housing 124 may be manufactured as a single component, or molded or machined together as a single component. Further still, in an alternate embodiment of the golf training apparatus, the base 110, the elongated support member 122, and the annular housing 124 may together be manufactured as a single, integrated component—or molded or machined together to form a single component.

Figures 1A, 1B, 1C, 1D:
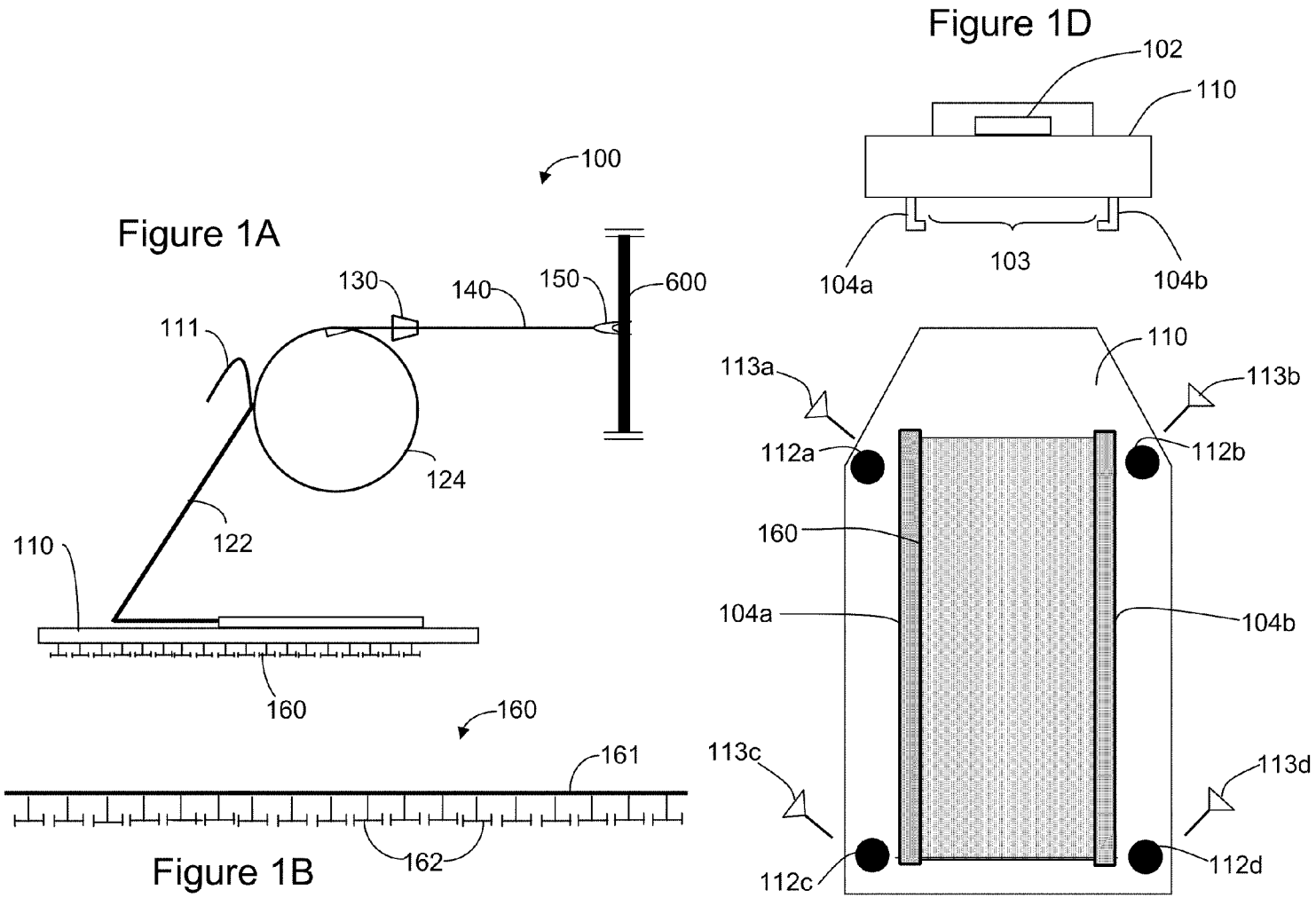
FIG. 1A shows a perspective view of the golf training apparatus, configured for indoor use.
FIG. 1B shows a side view of the cleated surface for indoor use.
FIG. 1C shows an illustrative view of the undersurface of the golf training apparatus, fitted with the cleated surface for indoor use.
FIG. 1D shows a side view of the base of the golf training apparatus.

Referring to FIG. 1D, the elongated support member 122 may be coupled to, or slidably coupled to, the base 110 by way of a receiving port 102. The receiving port 102 may be molded or machined into the base 110 by way of a variety of manufacturing processes, some of which are described above. Importantly, by sliding the member 122 into and out of the receiving port 102, the member 122 may easily be coupled to and decoupled from the base 110.

At the apex of the elongated support member 122, there is disposed the annular housing 124. Briefly (more detail is provided surrounding the discussion of FIGS. 5-8), the housing 124 contains a tensile mechanism 502 coupled to a guide line 140, whereby the guide line 140 may be dispensed from the housing 124, as well as retracted, in the absence of a counterforce, into the housing. At the apex of the elongated support member 122, there is, additionally, a curved projection 111. The curved projection 111 is configured such that a person may easily utilize the projection 111 as a hook for manually grasping and transporting the golf training apparatus 100. The curved projection 111 also adds an aesthetically pleasing design feature to the apparatus 100.

With respect to the guide line 140, a stop 130 may be provided, whereby a certain distance or length of line is prevented from retracting into the housing. In one embodiment, the stop is located ten to fourteen inches from clip 150. The stop 130 also functions to maintain some tension in the tensile mechanism 502, such that the stop 130 is held snugly against the body of the housing.

The guide line 140 is also coupled to a clip 150. Clip 150 may be coupled to the shaft 600 of a golf club or golf putter. Clip 150 may be provided in a variety of sizes to accommodate attachment of the guide line 140 to variously sized club/putter shafts 600. Further, clip 150 may be removably coupled to the guide line 140, such that variously sized clips 150 may be switched into and out of operation. There are various means for coupling a clip to a line. However, in one embodiment, the coupling means is a slidable coupling.

With further regard to the guide line 140, there may be employed various colors and brightnesses of materials in the composition of the guide line, such that the guide line easily stands out against a grassy surface or carpeted floor. For instance, the guide line may be a bright orange or yellow color. Moreover, various lengths of guide line 140 may be used. In the depicted embodiment, 48 inches to 54 inches of guide line are provided. Other lengths might be used, however; and, where greater lengths are in fact used, one or more differently sized housings 124 might be provided.

The guide line 140 may be manufactured from virtually any flexible or semi-flexible material, such as, but not limited to, string, cable, filament, cord, sheathed cord, twine, rope, ribbon, tape, and the like. In one embodiment, the guide line 140 comprises nylon twine. The guide line 140 may further include markings or graduations (not shown)—to which the stop 130 may be set—whereby a player may adjust the force required to cause additional dispensation of the guide line. Thus, for instance, a player who wishes to practice putting a longer distance might increase the force required to extract the required line by moving the stop inward along the guide line until the tensile mechanism 502 in the housing is under greater stress. The markings on the guide line may therefore further indicate putting distances. For instance, a force required to putt a ball ten feet on an average putting green may be calculated prior to manufacture of the guide line and a mark thereafter placed on the guide line indicating that attachment of the stop at the designated point will necessitate a swing having a force substantially similar to that which would be required to move a ball a distance of ten feet on a putting green. Thus, the golf training apparatus may be adjusted to help players learn to swing with an appropriate force, depending upon the distance they wish to propel variously putted golf balls.

Referring to FIG. 1B, there is illustrated an embodiment of a cleated surface 160, which may be coupled to the base 110 (as illustrated in FIG. 1A) during an indoor mode of operation of the golf training apparatus. The cleated surface includes a flat planar surface 161 and a plurality of "T" shaped cleats or teeth 162. The cleats 162 are attached to the surface 161 and may not be removed. In general, the cleats 162 and the surface 161 may be manufactured as a single component, or molded or machined together as a single component. Further, in one embodiment, the cleated surface comprises a rigid plastic (or any material similar to that used for construction of the base 110 as provided above), and may comprise a variety of colors, including blue and gray.

More particularly, referring now to FIG. 1D, the cleated surface may slidably couple to a second receiving port 103 set into the base 110. In one embodiment, the receiving port 103 comprises two rails 104*a* and 104*b*. These rails 104*a* and 104*b* may receive the cleated surface 160, such that the cleated surface may be coupled to the base 110 by sliding it into the receiving port 103. In other embodiments, the cleated surface 160 does not couple to the base by way of receiving port 103. Thus, in certain embodiments, the base 110 does not include receiving port 103. Further, in these embodiments, the cleated surface 160 may be coupled to the base 110 by another means, such as by way of a reusable or durable adhesive, Velcro, or permanent bonding means, such as glue, heat treatment, or screws. Further, in certain embodiments, the cleated surface 160 may be manufactured such that it is integral to the base 110, such as by an injection molding process or by machining the base 110 and cleated surface 160 from a single piece of material.

In certain embodiments, particularly those permitting coupling and decoupling of the cleated surface 160 to and from the base 110 (such as by way of receiving port 103), the cleated surface may be decoupled from the base, inverted, and coupled in an inverted position to the base 110, such that the cleats 162 are turned upward, into the base. In operation, a player may wish to configure the training apparatus 100 as described, with the cleated surface 160 in an inverted position, before using the apparatus 100 in an outdoor mode of operation, as this would prevent the cleated surface 160 from picking up grass and dirt, which it might encounter on a putting green.

Referring to FIG. 1C, an underside of the golf training apparatus 100 is displayed. The cleated surface 160 is further displayed coupled to the base 110. Thus, the golf training apparatus 100 is shown configured for indoor use. There are additionally disposed in the base 110 a plurality of anchor points 112*a*, 112*b*, 112*c*, and 112*d* (hereinafter, also referred to as the "anchor points.") In the depicted embodiment, there are four anchor points 112*a*, 112*b*, 112*c*, and 112*d*, one at each corner of the base 110; however, a greater or lesser number of anchor points might also be used.

The anchor points 112*a*, 112*b*, 112*c*, and 112*d* extend through the base 110, and are configured to receive a plurality of anchors 113*a*, 113*b*, 113*c*, and 113*d*. The anchors may be any cylindrical element capable of being driven into a putting green or grassy surface—e.g., stakes, sticks, nails, and small posts. However, in the depicted embodiment, the anchors are golf tees. Thus, the golf training apparatus of FIG. 1C is also shown configured, or configurable, for outdoor use as well as indoor use. In some embodiments, as described above, the cleated surface 160 is inverted during outdoor use, such that the cleats do not pick up debris. In other embodiments, the cleats 162 remain deployed during outdoor use.

Figure 2:
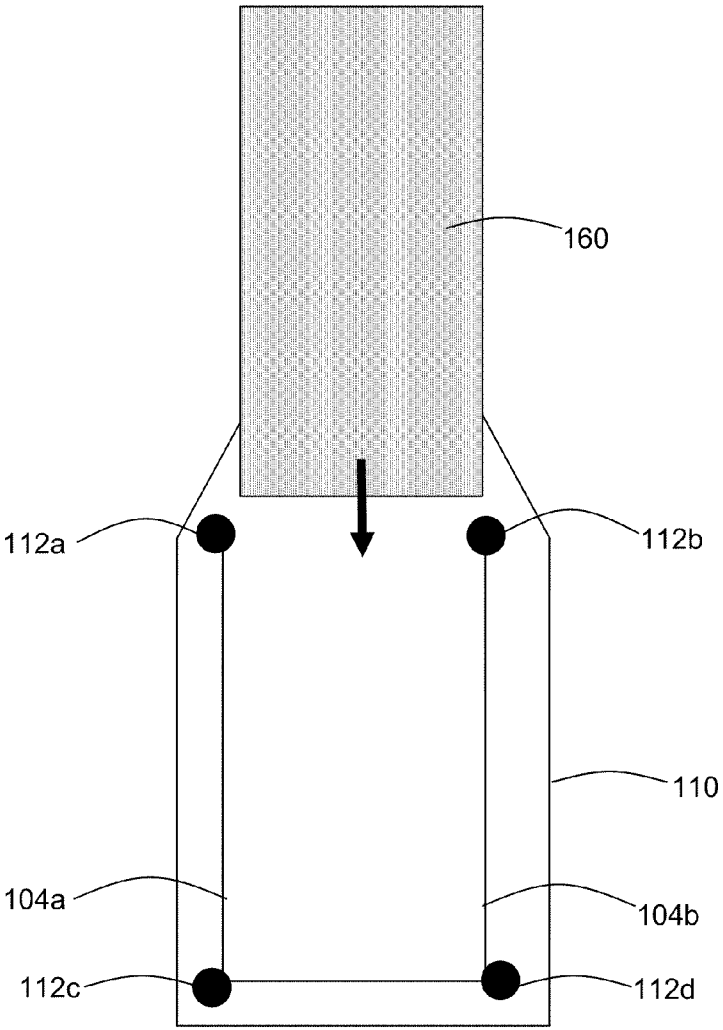
FIG. 2 shows an illustrative view of the undersurface of the golf training apparatus configured to slidably receive the cleated surface for indoor use.

Referring now to FIG. 2, there is provided an illustration of the cleated surface 160 sliding into—or slidably coupling with—the base 110. The cleated surface 160 is received by the rails 104*a* and 104*b* (see above for additional detail). Note that anchor points 112*a*, 112*b*, 112*c*, and 112*d* are disposed such that insertion of the cleated surface 160 does not interfere with insertion of an anchor—i.e., the base is wider along its shorter rectangular dimension than the cleated surface 160 is along its shorter rectangular dimension. In other embodiments, however, the cleated surface 160 may be congruent with (i.e., of the same or substantially the same dimensions as) the base 110. In these embodiments, anchor points 112*a*, 112*b*, 112*c*, and 112*d* extend through the cleated surface 160, so that the apparatus 100 may be used outdoors.

Figure 3B:
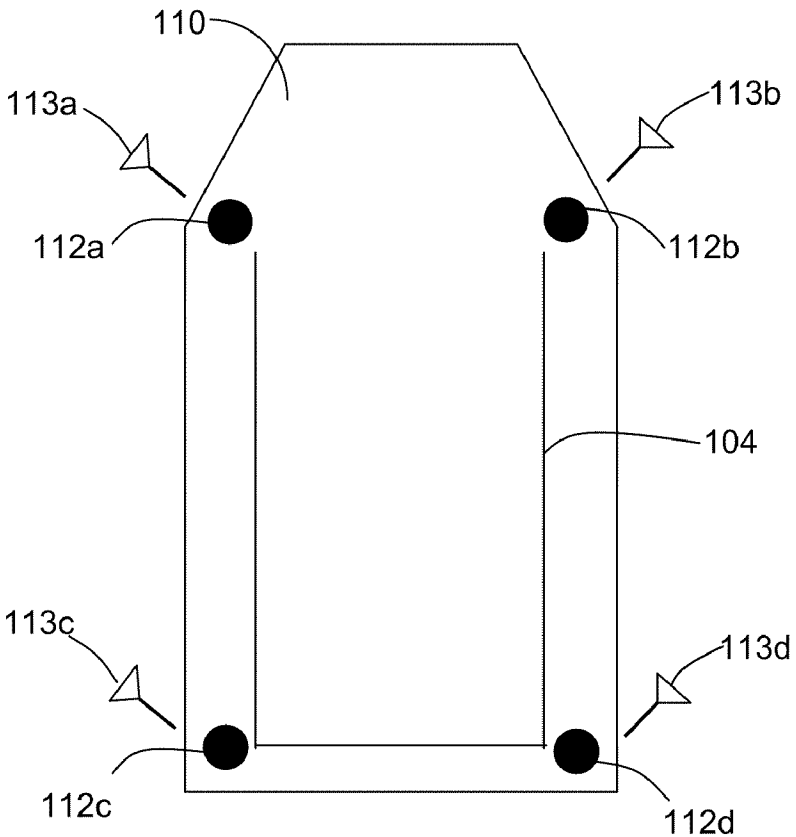
FIG. 3B shows a top view of the golf training apparatus configured for outdoor use.
Figure 3A:
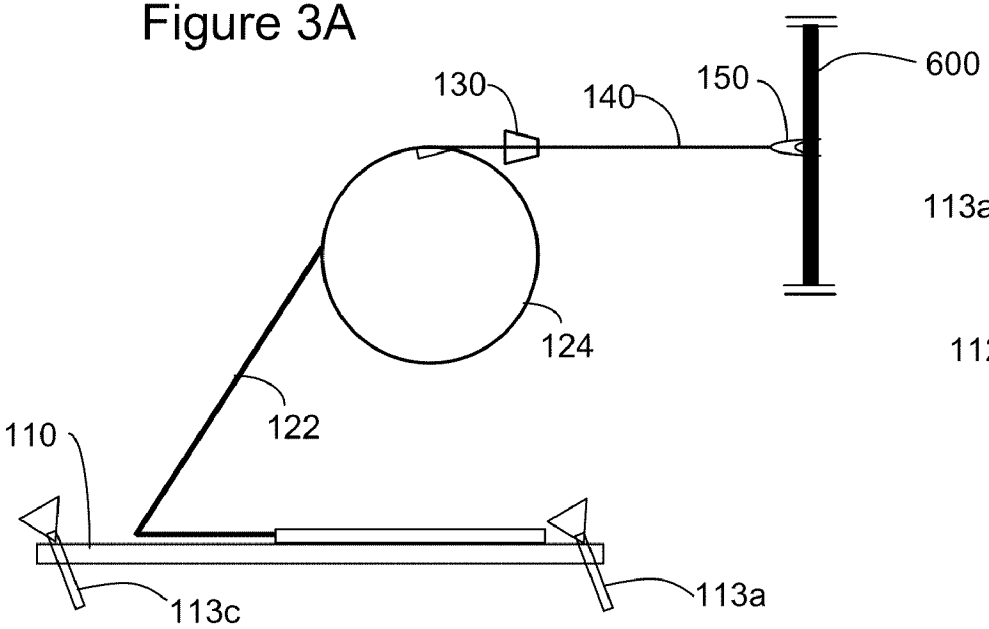
FIG. 3A shows an perspective view of the golf training apparatus configured for outdoor use.

FIG. 3A is a side view of the apparatus 100. The apparatus 100 is attached via the guide line 140 and clip 150 to the shaft 600 of a golf club or putter (see above for additional detail). FIG. 3A further illustrates anchors 113*c* and 113*a* inserted through anchor points 112*a* and 112*c*. Cleated surface 160 is not coupled to the base 110 in this figure; thus, the embodiment depicted here is configured for use outdoors. Although the receiving port 103 is not shown, it may nonetheless be present in this embodiment, in which case, it may be inverted and facing upwards such that the cleated surface 160 does not come into contact with the putting green.

FIG. 3B is a top view of the base 110. The figure further illustrates the direction the anchors 113*a*, 113*b*, 113*c*, and 113*d* are to be inserted through the anchor points 112*a*, 112*b*, 112*c*, and 112*d*—that is, downward, through the base 110 and into the grassy surface.

Figure 4:
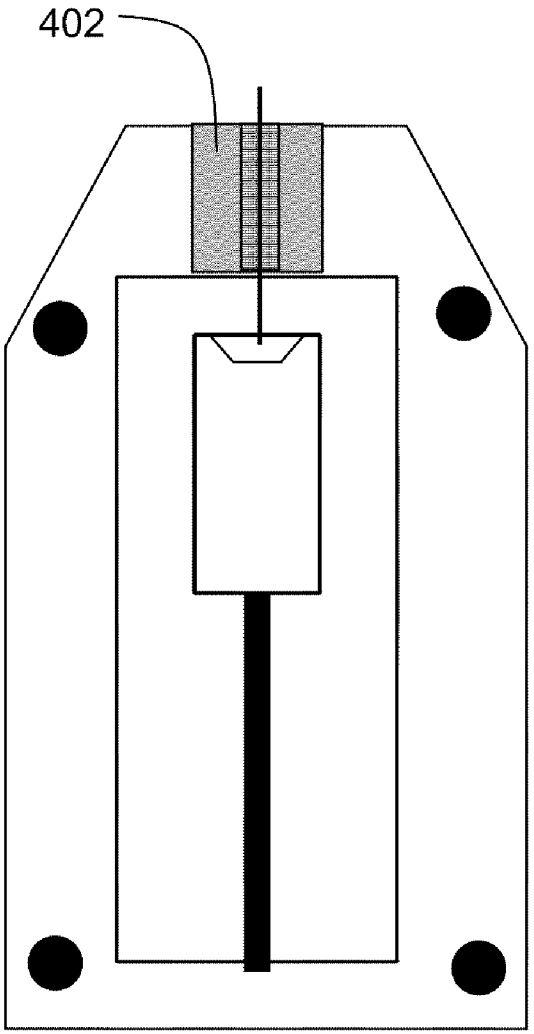
FIG. 4 shows a top view of the golf training apparatus.

FIG. 4A is a top view of an alternative embodiment of the golf training apparatus 100. In particular, FIG. 4A illustrates a striped area 402 that may be used during operation to visually detect the angle at which a player is striking a ball.

Figure 5:
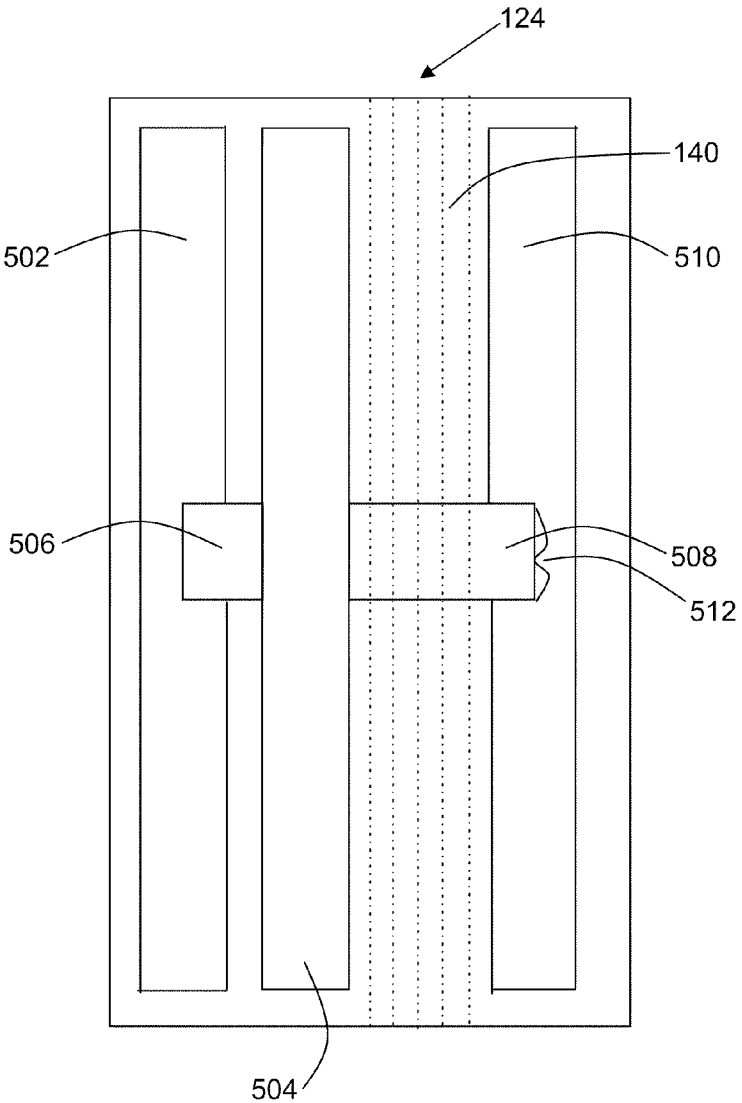
FIG. 5 shows a cross-sectional view of the annular housing.

Referring now to FIG. 5, a cross-sectional illustration of the housing 124, and its contents, is provided. The housing 124 comprises a tensile mechanism 502, an annular disc 504, a first elongated cylindrical member 506, a second elongated cylindrical member 508, a detachable face 510, and the guide line 140. The first and second elongated members 506 and 508 are coupled to the annular disc 504 at the center of the disc 504. As illustrated, the first and second elongated members 506 and 508 are coupled to opposite sides of the disc 504.

Figure 6B:
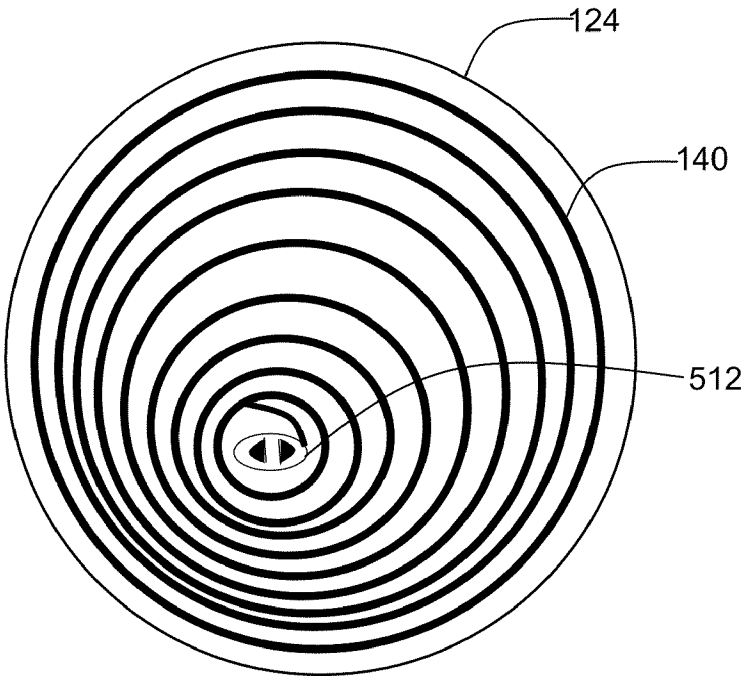
FIG. 6B shows a cross-sectional view of the annular housing illustrative of the guide line.
Figure 6A:
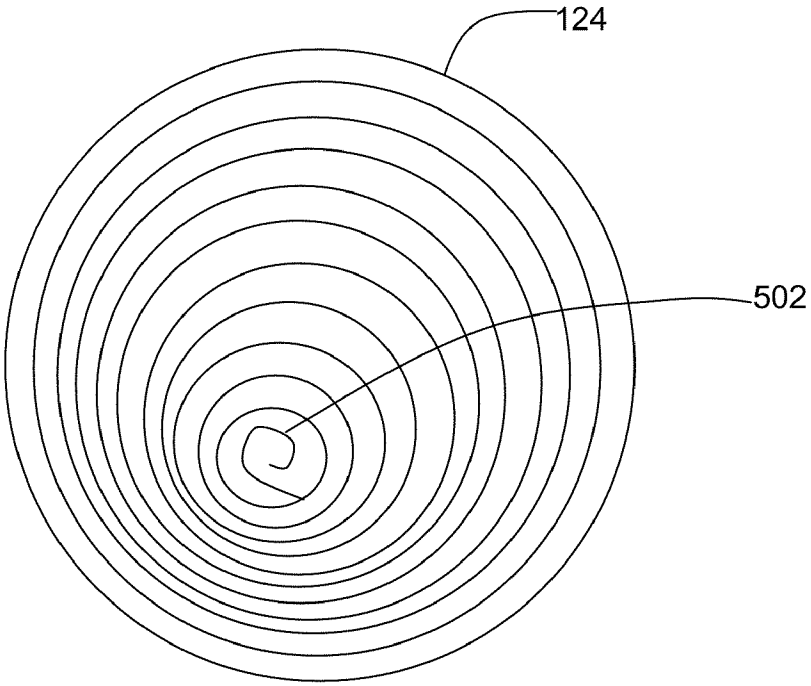
FIG. 6A shows a cross-sectional view of the annular housing illustrative of the concentrically wound spring.
Figure 7B:
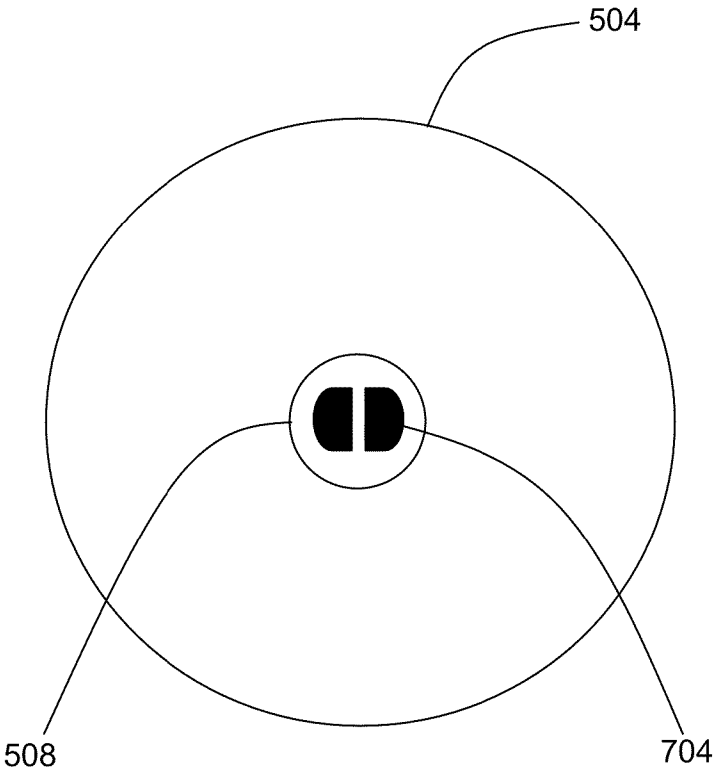
FIG. 7B shows a cross-sectional view of a second side of the annular disc configured to interface with the guide line.
Figure 7A:
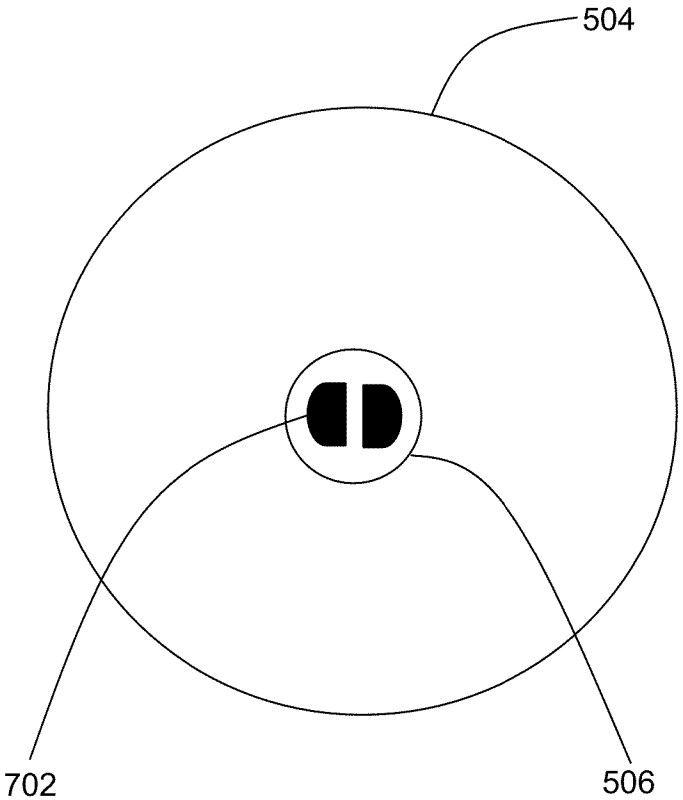
FIG. 7A shows a cross-sectional view of a first side of the annular disc configured to interface with the tensile mechanism.
Figure 8B:
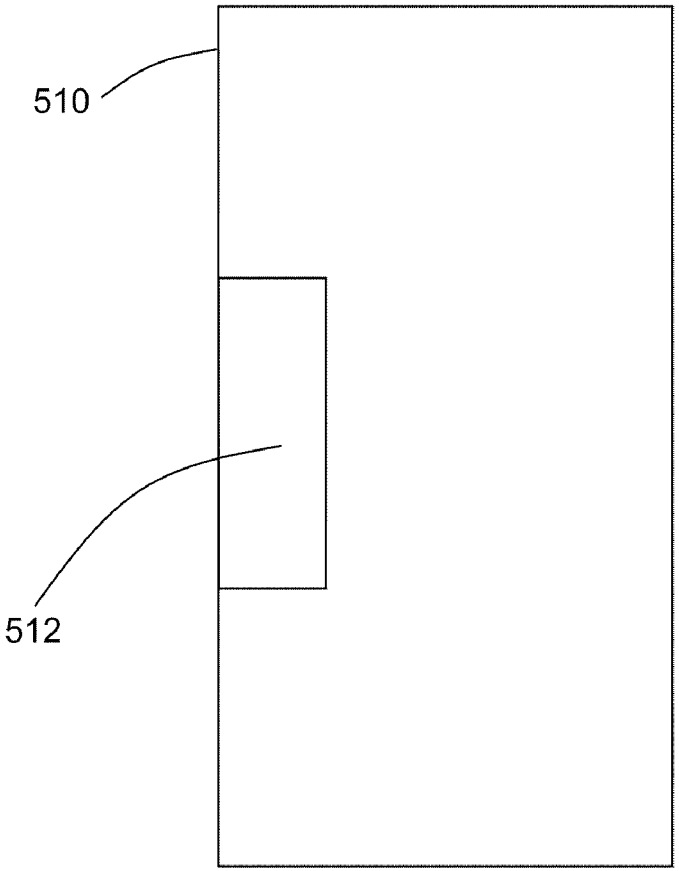
FIG. 8B shows a side view of the removable face of the annular housing.
Figure 8A:
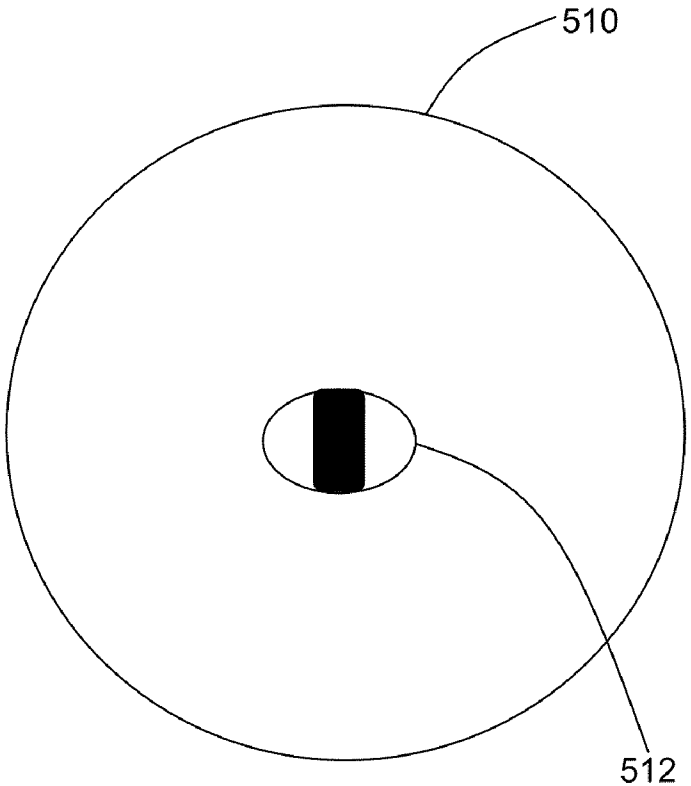
FIG. 8A shows a cross-sectional view of a second side of the removable face of the annular housing.

As is additionally illustrated, the tensile mechanism 502—which in one embodiment is a concentrically wound spring—is physically separated from the guide line 140 by the annular disc 504 (see also FIG. 6A). The annular disc 504 is coupled to the tensile mechanism 502 through a slot 702 (see also FIG. 7A) in the first elongated member 506. More particularly, in the depicted embodiment, the tensile mechanism 502, which, again, may comprise a thin strip of concentrically wound metal tape or a spring, is coupled to the first elongated member 506 by insertion of a distal or end portion of the mechanism 502 into the slot 702. Thus, angular motion (i.e., rotation) of the first elongated member 506 causes the mechanism 502 to wind and unwind, depending on the direction of motion. Note: in the depicted embodiment, the opposite distal end of the tensile mechanism 502 is attached (e.g., using glue or another permanent adhesive) to the inside of the housing.

On the other side of the annular disc 504, the second elongated member 508 extends away from the disc 504 and into a slotted cavity 512 (see also FIG. 6B, FIG. 7B, and FIGS. 8A and 8B) in the detachable face 510. The second elongated member 508 also terminates in a slot 704. This arrangement permits easy coupling and decoupling of the detachable face 510 from the housing 124, because the slot 704 is configured to securely interface with the slotted cavity 512. In alternative embodiments, the detachable face 510 may be permanently attached to the housing 124.

The guide line 140 is wound around the second elongated member 508, and attached to the annular disc 504. Attachment may occur in a variety of ways—e.g., via adhesive, a nail or screw, or by including a hole (as in the depicted embodiment) in the disc 504, such that a distal end of the guide line 140 may be passed through the disc and one or more knots tied in the guide line 140, thereby securing it to the disc 504.

The tensile mechanism 502 is therefore affected by the motion of the guide line 140 by way of the annular disc 504. More particularly, as the guide line 140 is drawn from the housing 124, the annular disc rotates. Rotation of the annular disc 504 causes the tensile mechanism 502 to be wound around the first elongated member 508, thereby increasing the tension or compression in the mechanism 502. Conversely, as the guide line 140 is allowed to retract into the housing, the tensile mechanism uncompresses as it unwinds about the first elongated member 508, thereby causing the annular disc 504 to rotate in the opposite direction.

Figure 9:
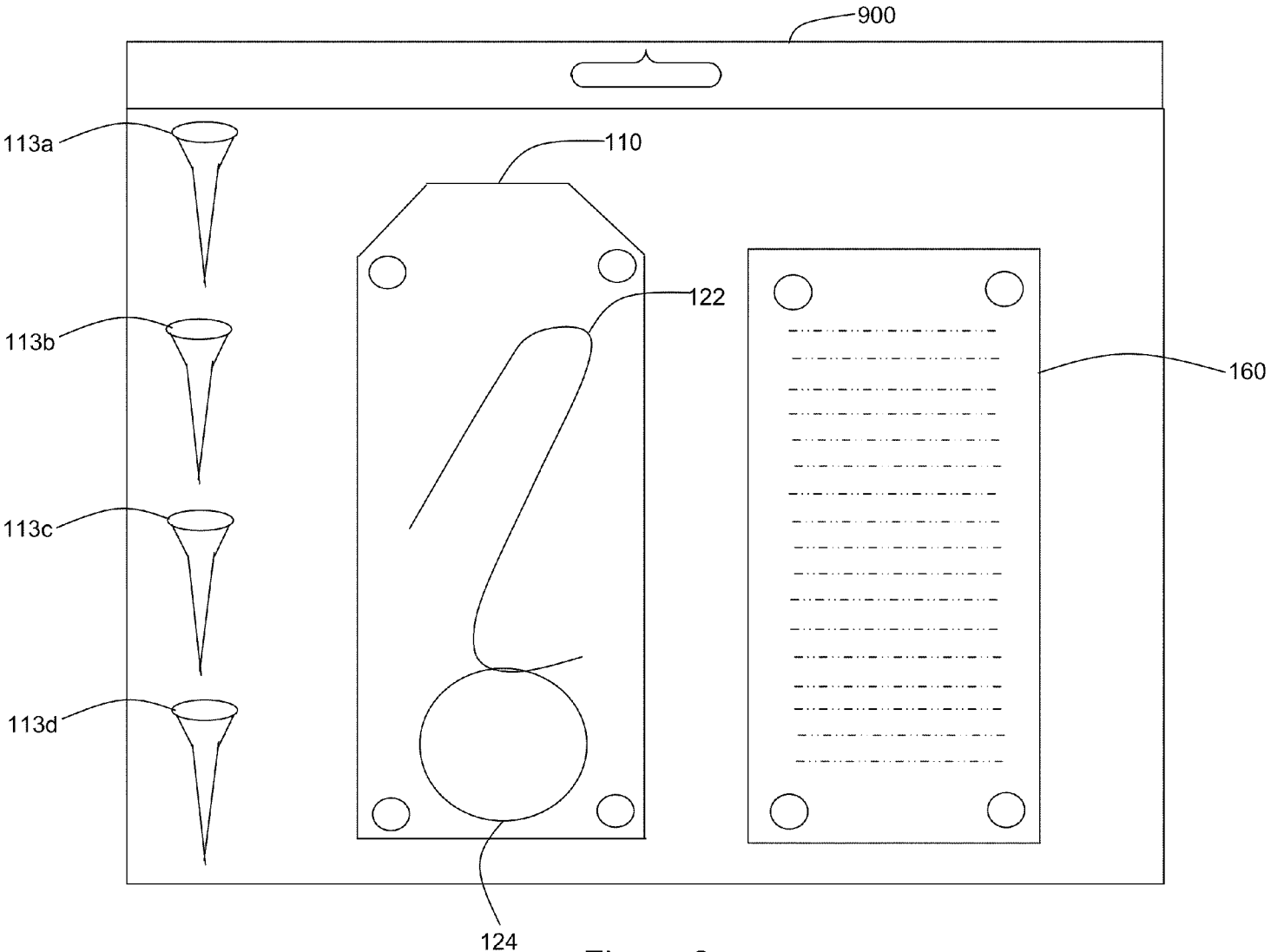
FIG. 9 shows a kit comprising the golf training apparatus.

Referring to FIG. 9, a kit 900 containing the pieces and parts of a complete golf training apparatus 100 is pictured. The kit may contain one or more anchors 113*a*, 113*b*, 113*c*, and 113*d*, the base 110, the elongated support member 122, the housing 124 and all its contents, and the cleated surface 160. The kit may be packaged such that it is capable of being offered for sale at a retail outlet.

Figure 10:
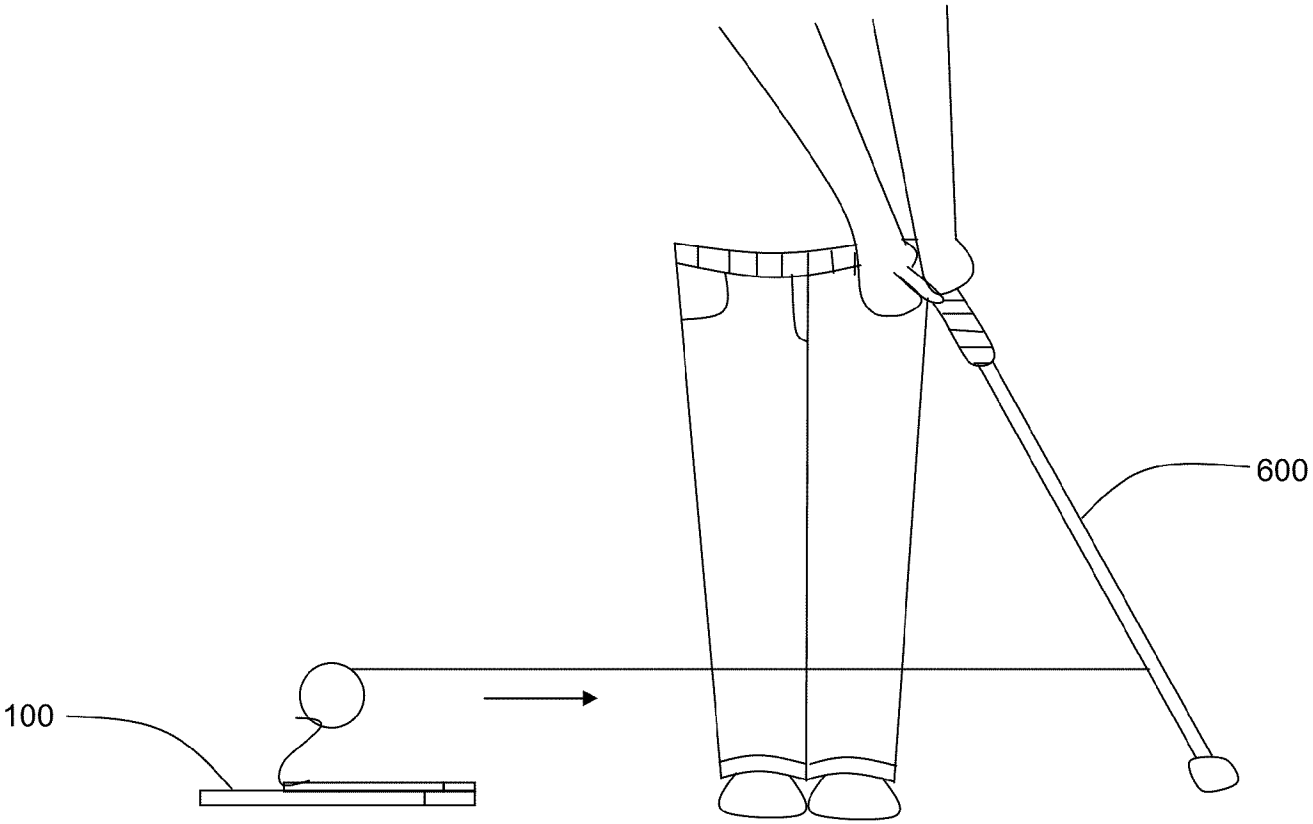
FIG. 10 illustrates the operation of the golf training apparatus.

In operation, the golf training apparatus 100 is coupled to the shaft 600 of a golf club or putter by way of clip 150. Referring to FIG. 10, the player may position the apparatus 100 somewhat to the rear of his golf stance in order to permit the putter, as it is swung, to travel freely (i.e., without striking the apparatus 100) through the stroke. Further, the apparatus is aligned with the target (i.e., the ball) such that a good stroke (see background section above) will trace a straight line (via the guide line 140) between the apparatus and the target.

Further, to take advantage of the golf training apparatus 100, a player may visually inspect the position and motion of the line 140 as it is dispensed from the housing 124 on the forward part of his stroke, as well as retracted into the housing on the return stroke. The striped area 402 may be used to assist this process.

If the player detects a departure from the ideal straight line between apparatus 100 and the target, the player is thereby made aware that he is pushing or pulling his stroke to the left or the right. At that point, the player may attempt to correct for the mistake in his stroke by adjusting his grip or another characteristic of his swing.

Although the description above provides many specifications, these should not be construed as limiting the scope of the invention, but as merely providing illustrations of some of the presently preferred embodiments this invention. The specification, for instance, makes reference to several methods for utilizing this invention. However, these methods, while they represent several preferred embodiments, should not be construed as representative of the only embodiments contemplated herein. Rather, those embodiments are illustrative, and may be altered and adapted based upon such factors as the particular structural embodiment implemented for use with the method, as well as what type of correction the player is attempting to detect and correct. Further, the specification makes references to a tensile mechanism 502 for dispensing and retracting the guide line 140. The tensile mechanism may comprise a variety of mechanisms capable of effecting a retraction of the guide line 140 into the housing 124, such as those mechanisms utilized to effect the same or similar effect in tape measures and the like.

The invention claimed is:

1. An indoor/outdoor golf swing training apparatus, comprising:

a base having at least one anchor point configured to receive at least one anchor to anchor the base to a grassy surface;

a cleated surface that slidably couples with a first receiving port in the base, the cleated surface including a plurality of cleats configured to grasp a carpeted surface;

an elongated support member that slidably couples with a second receiving port in the base;

an annular housing attached to a distal end of the elongated support member, the annular housing including a tensile mechanism and a guide line, wherein the guide line is colored to stand out against and grassy surface or a carpeted surface and the guide line is retractably coupled to the tensile mechanism; and a clip that attaches to a golf putter and the guide line.

2. The indoor/outdoor golf swing training apparatus of claim 1, wherein a golf tee is driven through the at least one anchor point to anchor the base to a grassy surface.

3. The indoor/outdoor golf swing training apparatus of claim 1, wherein the base includes four anchor points.

4. The indoor/outdoor golf swing training apparatus of claim 3, wherein a golf tee is driven through the at least one anchor point to anchor the base to a grassy surface.

5. The indoor/outdoor golf swing training apparatus of claim 1, wherein the cleated surface slidably couples with the first receiving port in the base such that the cleats contact an undersurface of the base.

6. The indoor/outdoor golf swing training apparatus of claim 1, wherein the guide line comprises a bright orange color.

7. A kit containing an easily assembled indoor/outdoor golf swing training apparatus, the kit comprising:

a base comprising a plurality of anchor points configured to receive at least one anchor to anchor the base to a grassy surface;

a cleated surface that slidably couples with a first receiving port in the base, the cleated surface including a plurality of cleats configured to grasp a carpeted surface;

an elongated support member that slidably couples with a second receiving port in the base;

an annular housing attached to a distal end of the elongated support member, the annular housing including a tensile mechanism and a guide line, wherein the guide line is colored to stand out against and grassy surface or a carpeted surface and the guide line is retractably coupled to the tensile mechanism;

at least one clip that attaches to a golf putter and the guide line;

a package configured to receive the base, the cleated surface, the elongated support member, the annular housing, and the clip.

8. The indoor/outdoor golf swing training apparatus of claim 7, wherein the cleated surface slidably couples with the first receiving port in the base such that the cleats contact an undersurface of the base.

9. The kit containing the indoor/outdoor golf swing training apparatus of claim 7, further comprising at least one golf tee, the tee included in the package.

10. The kit containing the indoor/outdoor golf swing training apparatus of claim 7, wherein the base includes four anchor points.

11. The kit containing the indoor/outdoor golf swing training apparatus of claim 10, further comprising four golf tees, the tees included in the package.

* * * * *